US010138678B2

(12) United States Patent
Bohlen et al.

(10) Patent No.: US 10,138,678 B2
(45) Date of Patent: Nov. 27, 2018

(54) SPRING SYSTEM FOR ROLLER BLINDS

(71) Applicant: Hunter Douglas Industries B.V., Rotterdam (NL)

(72) Inventors: Jorg Bohlen, Langen (DE); Lars Koop, Bremerhaven (DE)

(73) Assignee: Hunter Douglas Industries B.V., Rotterdam (NL)

( * ) Notice: Subject to any disclaimer, the term of this patent is extended or adjusted under 35 U.S.C. 154(b) by 311 days.

(21) Appl. No.: 14/309,499

(22) Filed: Jun. 19, 2014

(65) Prior Publication Data

US 2014/0360684 A1 Dec. 11, 2014
US 2016/0138333 A2 May 19, 2016

Related U.S. Application Data

(63) Continuation of application No. 13/146,985, filed as application No. PCT/EP2010/000694 on Feb. 4, 2010, now Pat. No. 8,776,861.

(30) Foreign Application Priority Data

Feb. 9, 2009 (EP) ..... 09001768

(51) Int. Cl.

| | |
|---|---|
| ***E06B 9/62*** | (2006.01) |
| ***E06B 9/68*** | (2006.01) |
| ***E06B 9/42*** | (2006.01) |
| *E06B 9/74* | (2006.01) |

(52) U.S. Cl.
CPC ..... *E06B 9/62* (2013.01); *E06B 9/42* (2013.01); *E06B 9/68* (2013.01); *E06B 9/74* (2013.01)

(58) Field of Classification Search
CPC ..... E06B 9/62
USPC ..... 160/191, 192, 313; 185/9, 11, 37, 40 R
See application file for complete search history.

(56) References Cited

U.S. PATENT DOCUMENTS

| | | | | |
|---|---|---|---|---|
| 1,678,590 A | | 7/1928 | Dixson | |
| 1,938,729 A | | 12/1933 | Traut | |
| 2,540,742 A | | 2/1951 | Langer | |
| 2,674,306 A | | 4/1954 | Prieto | |
| 2,722,273 A | * | 11/1955 | Taylor | 160/191 |
| 2,842,198 A | | 7/1958 | Prieto | |

(Continued)

FOREIGN PATENT DOCUMENTS

| | | |
|---|---|---|
| AU | 622268 B2 | 9/1991 |
| CA | 1301052 C | 5/1992 |

(Continued)

OTHER PUBLICATIONS

U.S. Appl. No. 14/309,571, filed Jun. 19, 2014.
U.S. Appl. No. 14/380,925, filed Feb. 27, 2013.

*Primary Examiner* — Katherine W Mitchell
(74) *Attorney, Agent, or Firm* — Dority & Manning, P.A.

(57) ABSTRACT

A method of selecting one or more springs for a roller blind is provided. The method may include determining one or more parameters of the blind, determining a torque curve of the blind based on the one or more parameters of the blind, and selecting one or more springs having a wire diameter and a spring diameter. The method may further include determining a length of the one or more springs based on the torque curve, the wire diameter of the one or more springs, and the spring diameter of the one or more springs to ensure the blind operates with a constant operating force.

19 Claims, 10 Drawing Sheets

(56) References Cited

U.S. PATENT DOCUMENTS

| | | | | |
|---|---|---|---|---|
| 4,030,567 | A | 6/1977 | Kondo | |
| 4,171,845 | A | 10/1979 | Hirsch | |
| 4,535,830 | A | 8/1985 | Appel et al. | |
| 4,766,941 | A | 8/1988 | Sloop et al. | |
| 4,884,618 | A | 12/1989 | Steeves | |
| 5,044,417 | A | 9/1991 | Bresson | |
| 5,105,871 | A | 4/1992 | Baud et al. | |
| 5,167,269 | A | 12/1992 | Abo | |
| 5,437,324 | A | 8/1995 | Sternquist | |
| 5,460,216 | A | 10/1995 | Hirao et al. | |
| 5,799,716 | A | 9/1998 | Yamaguchi et al. | |
| 5,803,150 | A | 9/1998 | Boiteau | |
| 5,975,185 | A | 11/1999 | Miller et al. | |
| 6,230,785 | B1 | 5/2001 | Tokuyama et al. | |
| 6,378,594 | B1 | 4/2002 | Yamanaka et al. | |
| 6,536,503 | B1 | 3/2003 | Anderson et al. | |
| 6,685,592 | B2 | 2/2004 | Fraczek et al. | |
| 7,195,052 | B2 | 3/2007 | Nien et al. | |
| 7,237,592 | B2 | 7/2007 | Arnoux et al. | |
| 7,726,379 | B2 | 6/2010 | Beau | |
| 7,967,051 | B2 | 6/2011 | Diaz | |
| 8,205,657 | B2 | 6/2012 | Bohlen | |
| 8,258,993 | B2 | 9/2012 | Inoue et al. | |
| 8,299,734 | B2 | 10/2012 | Mullet et al. | |
| 8,368,328 | B2 | 2/2013 | Mullet et al. | |
| 8,776,861 | B2 | 7/2014 | Bohlen et al. | |
| 2003/0000657 | A1 | 1/2003 | Dupielet et al. | |
| 2004/0226669 | A1* | 11/2004 | Webb | 160/299 |
| 2005/0126723 | A1 | 6/2005 | Arnoux et al. | |
| 2008/0060771 | A1 | 3/2008 | Sugiyama et al. | |
| 2010/0269988 | A1 | 10/2010 | Mullet et al. | |
| 2011/0024064 | A1 | 2/2011 | Ng | |
| 2011/0048655 | A1 | 3/2011 | Andreasen et al. | |
| 2011/0297334 | A1 | 12/2011 | Bohlen et al. | |
| 2015/0034259 | A1 | 2/2015 | Bohlen et al. | |

FOREIGN PATENT DOCUMENTS

| | | | |
|---|---|---|---|
| CN | 2203571 | Y | 7/1995 |
| CN | 2490940 | Y | 5/2002 |
| CN | 2639497 | Y | 9/2004 |
| CN | 1643231 | A | 7/2005 |
| CN | 2793285 | Y | 7/2006 |
| CN | 200993888 | Y | 12/2007 |
| CN | 101285370 | A | 10/2008 |
| DE | 4211940 | A1 | 10/1993 |
| DE | 19935729 | A1 | 2/2001 |
| EP | 0651127 | A1 | 5/1995 |
| EP | 1947288 | A2 | 7/2008 |
| EP | 2256284 | A2 | 12/2010 |
| FR | 403577 | A | 11/1909 |
| GB | 1409891 | A | 10/1975 |
| GB | 2166480 | A | 5/1986 |
| JP | 5785482 | A | 5/1982 |
| JP | 2001/040966 | A | 2/2001 |
| JP | 2002235488 | A | 8/2002 |
| TW | 514152 | B | 12/2002 |
| WO | 2005/121487 | A1 | 12/2005 |
| WO | 2008075494 | A1 | 6/2008 |
| WO | 2008/141389 | A1 | 11/2008 |
| WO | 2008131761 | A1 | 11/2008 |
| WO | 2010/089118 | A1 | 8/2010 |
| WO | 2011/008267 | A2 | 1/2011 |

* cited by examiner

SPRING SYSTEM FOR ROLLER BLINDS

CROSS-REFERENCE TO RELATED APPLICATIONS

The present application is a continuation of U.S. patent application Ser. No. 13/146,985 filed on Aug. 26, 2011 and entitled "Spring System For Roller Blinds", which is the national stage application of PCT Patent Application No. PCT/EP2010/000694 filed on Feb. 4, 2010 and entitled "Spring System For Roller Blinds", which claims priority to European Patent Application No. 09001768.2 filed on Feb. 9, 2009 and entitled "Spring System For Roller Blinds", which applications are hereby incorporated by reference into the present application in their entireties.

BACKGROUND

Field

The invention relates to spring driven and spring assisted roller blinds and a spring mechanism for such roller blinds.

Description of the Relevant Art

The use of spring systems to drive by themselves, or to assist in the operation of, a roller blind is known in the art.

SUMMARY

In such blinds one of the important features that needs to be taken into account is that the spring must wind and tighten when the blind is lowered, so that upon lifting the blind, the spring can release the stored energy and lift or assist the operator in lifting the blind.

The direction of rotation to lift a roller blind, i.e. to wind its fabric sheet about its roller, depends also from which side of the roller the sheet depends—from the back or the front. Most roller blinds have their fabric sheet depending from the back, which is the side closest to the window being covered by the blind. The direction of rotation for winding up the sheet of such a back drop blind about its roller (without the sheet passing to the front first) is clockwise. This means that a clockwise wound, torsion spring will be needed to drive or assist the winding up of the sheet. Such a spring will not work for a front drop blind, in which its roller needs to rotate counter-clockwise to wind up its sheet about the roller.

Lifting of a roller blind can be driven by a spring. Lifting of a roller blind can also be driven by a combination of a spring and an operator such as a ball chain or a motor. The goal of spring assistance of an operator is to reduce the force needed to operate the blind by adding a spring which will release stored energy upon lifting the blind. Spring assistance systems are particularly useful for big roller blinds. Here too the spring has to be mounted to the roller so that rotation of the roller to unwind the sheet from the roller will cause the spring to tighten. Again, this will depend on whether the blind is a front or back drop blind. It will also depend on the operator of the blind which is operatively connected to one end of the blind's roller tube to drive the roller in both clockwise and counter-clockwise rotation.

In all spring-assisted roller blind systems, the spring has previously been attached to the operator. A clutch has often also been provided between the operator and the roller tube to prevent the sheet from unrolling from the roller under the under the sheet's own weight. As a result, prior spring-assisted blinds have not provided interchangeability of the ends of the roller tube to which the operator is connected and thus from which side the blind is operated. See e.g. FR 403,577, U.S. Pat. No. 4,884,618 and JP 2002-235488.

For this reason, fabricators of spring-assisted roller blinds have had to offer customers both dedicated left- and a right-side operator combination. Such combinations have been for both back and front drop blinds, and have included an operator, clutch and spring as pre-assembled units. Each blind has had to be assembled for one combination of these features, i.e., either a back drop and right hand operation or a back drop and left hand operation. Thus while with the unassisted roller blinds it has been possible, at a very late stage in production, to decide to attach an operator on a right or left side, while retaining the chosen back drop or front drop, this has not been possible for roller blinds with spring systems and operators. This has led to problems in installing spring-assist roller blinds. When the operator and spring system have been ordered on a wrong side, no correction has been possible because the spring has predetermined the direction of rotation of the roller with respect to the back or front drop of the blind.

It is an object of the invention to solve the problem of side selection for the operator for roller blinds with spring systems.

In relation to spring systems for roller blinds, another problem has been to properly determine and select the spring that will properly operate the blind. Previously, springs have been chosen to fit a range of blind sizes, particularly with respect to heights and widths, and have not been customized for individual blinds. The choice of a spring has previously involved only choosing the type of spring, particularly its wire diameter and spring diameter and its length. The length of the spring determines the maximum number of rotations it will be able to make, which in turn dictates the height of the blind for a given roller. A spring chosen for a range of blind sizes has usually been oversized for most of the blinds of the range.

Oversizing has had several drawbacks apart from the cost aspect. The main problem has been that the blind will not be operated with a constant force because its operating force changes during its operation as the torque of its roller changes when winding and unwinding its fabric. For a spring driven roller blind, this will result in acceleration of the roller when the blind is raised. A solution for this problem has been to provide a brake for the roller which provides progressively more braking force as the speed of the roller increases. See, for example, U.S. Pat. No. 6,536,503.

Since the torque of a roller blind changes as the blind is operated and the sheet winds about or unwinds from the roller, inclusion of such a standard and oversized spring causes an unevenness in the operating force needed to operate of a spring assisted blind. Thus for spring assisted roller blinds the result of such springs can be that the roller blind is heavier to operation to lower than to lift, or have a peak in force needed somewhere in the middle between lifting and lowering.

It is also an object of the invention to provide made to measure roller blinds, with springs that are designed specifically for the blind.

In a more general sense it is thus an object of the invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end and according to a first aspect of the invention provides a roller blind including:

a roller of having a roller length and a roller diameter, a fabric attached to said roller for winding and unwinding from said roller, the fabric having a fabric length, a fabric weight, a thickness and a fabric height, a bottom bar having a bottom bar weight, and at least one spring operatively connected to the roller to drivingly rotate the roller in at least one direction of rotation and the spring is selected according to a Protocol such that its length ensures that it drives the roller with a constant operating force.

Advantageously the roller blind includes an operating member.

Also advantageously the roller blind includes at least two springs each having identical lengths selected according to the Protocol and which springs in combination drive the roller with the constant operating force.

Further advantageously a roller blind is provided including at least two springs each having different lengths selected according to the Protocol and which springs in combination drive the roller with constant operating force. In the blinds with at least two springs, these springs can have identical wire diameters and spring diameters, or different wire diameters and spring diameters.

Still further advantageously, the Protocol according to which the springs for the roller blind are selected includes the following formula 1:

$$M = \left[\frac{\left[\left(\frac{\frac{\sqrt{\frac{4\times h_{st}\times t_{st}}{\pi}+d_{we}^2}-d_{we}}{2\times t_{st}}+\sqrt{\frac{4\times h_{st}\times t_{st}}{\pi}+d_{we}^2}\times b_{st}\times G_{ul}\times\left(\sqrt{\frac{4\times h_{st}\times t_{st}}{\pi}+d_{we}^2}-d_{we}\right)}{\left[d_{we}\times b_{st}\times(G_{ul}+h_{st}\times G_{st})-\sqrt{\frac{4\times h_{st}\times t_{st}}{\pi}+d_{we}^2}\times b_{st}\times G_{ul}\right]\times 2\times t_{st}}\right)\times\left(\frac{\left[d_{we}\times b_{st}\times(G_{ul}+h_{st}\times G_{st})-\sqrt{\frac{4\times h_{st}\times t_{st}}{\pi}+d_{we}^2}\times b_{st}\times G_{ul}\right]\times t_{st}}{\left(\sqrt{\frac{4\times h_{st}\times t_{st}}{\pi}+d_{we}^2}-d_{we}\right)}\right)\right]}{Md0_{Fe}\times n0_{Fe}}\right]$$

in which formula:

M=number of springs in the roller blind $d_{we}$=outer diameter of the roller $h_{st}$=height of the fabric sheet $b_{st}$=width of the fabric sheet $t_{st}$=thickness of the fabric sheet $G_{st}$=Weight of the fabric sheet $G_{ul}$=Weight of the bottom rail $Md0_{Fe}$=assumed torque increase of the spring w.r.t. it's length $LK0_{Fe}$ $n0_{Fe}$=maximum number of rotations for $LK0_{Fe}$ Yet further advantageously, the Protocol according to which the springs for the roller blind are selected includes the following formula 2:

$$LK1_{Fe} = \frac{LK0_{Fe}\times Md0_{Fe}\times M\times\left(\sqrt{\frac{4\times h_{st}\times t_{st}}{\pi}+d_{we}^2}-d_{we}\right)}{\left[d_{we}\times b_{st}\times(G_{ul}+h_{st}\times G_{st})-\sqrt{\frac{4\times h_{st}\times t_{st}}{\pi}+d_{we}^2}\times b_{st}\times G_{ul}\right]\times t_{st}}$$

in which formula:

M=number of springs in the roller blind $d_{we}$=outer diameter of the roller $h_{st}$=height of the fabric sheet $b_{st}$=width of the fabric sheet $t_{st}$=thickness of the fabric sheet $G_{st}$=Weight of the fabric sheet $G_{ul}$=Weight of the bottom rail $Md0_{Fe}$=assumed torque increase of the spring w.r.t. it's length $LK0_{Fe}$ $LK0_{Fe}$=assumed spring length w.r.t. to $Md0_{Fe}$ $LK1_{Fe}$=calculated spring length adapted to the roller blind $n0_{Fe}$=maximum number of rotations for $LK0_{Fe}$ $n1_{Fesp}$=number of rotations as pre-tension of the blind in the lifted position Still further advantageously the roller blind of the invention includes:

a spring assist module including a stationary carrier connectable to a roller blind operator unit;

at least one torsion spring having a first and a second spring end;

at least one rotatable member to be keyed to a roller blind tube such that rotation of the roller blind tube rotates the rotatable member; and the torsion spring having the first end operatively coupled to the stationary member and the second end operatively coupled to the rotatable member; whereby in use upon rotation of the rotatable member in one direction of rotation kinetic energy may be stored by the torsion spring from the rotatable member and upon rotation of the rotatable member in an opposite direction of rotation any kinetic energy stored by the torsion spring may be released to the rotatable member and wherein the spring assist module is pre-assembled as a self-contained unit.

This blind can thus be operated from either the right or left side without having to replace the torsion spring.

According to a further aspect of the invention a spring assist module is provided, including a stationary carrier connectable to a roller blind operator unit;

at least one torsion spring having a first and a second spring end;

at least one rotatable member to be keyed to a roller blind tube such that rotation of the roller blind tube rotates the rotatable member; and the torsion spring having the first end operatively coupled to the stationary member and the second end operatively coupled to the rotatable member; whereby in use upon rotation of the rotatable member in one direction of rotation kinetic energy may be stored by the torsion spring from the rotatable member and upon rotation of the rotatable member in an opposite direction of rotation any kinetic energy stored by the torsion spring may be released to the rotatable member and wherein the spring assist module is pre-assembled as a self-contained unit.

Advantageously the spring assist module can have its stationary carrier including a central shaft.

In particular the central shaft can have a continuous unround profile. More in particular it is advantageous for the torsion spring to concentrically surrounding the central shaft. Such features in particular make the module suitable for incorporation into architectural coverings of the roller blind type and the module can be conveniently accommodated within the blind roller. Advantageously the stationary carrier has a connector on each axial end for keeping the stationary carrier stationary with respect to the architectural covering to which it is adapted to cooperate. Further advantageously the connectors on either axial end of the stationary carrier also maintain the integrity of the spring assist module as a self-contained unit.

Yet further advantageously the spring or springs of the spring assist module is or are selected according to a Protocol taking into account a set of parameters of the window covering to be assisted by the spring assist module, such that the at least one spring selected by the Protocol has a length that ensures that it drives the window covering with a constant operating force.

Advantageously the spring assist module includes at least two springs each having equal lengths and the springs being selected according to the Protocol and which springs in combination drive the window covering with constant operating force.

Also advantageously the spring assist module includes at least two springs having different lengths and the springs being selected according to the Protocol and which springs in combination drive the window covering with constant operating force.

According to a further advantage the springs of the spring assist module have identical wire diameters and/or spring diameters.

According to a further advantage the springs of the spring assist module have different wire diameters and/or spring diameters.

BRIEF DESCRIPTION OF THE DRAWINGS

The invention is further elucidated with reference to the accompanying drawings, in which.

DETAILED DESCRIPTION OF THE INVENTION

Figure 1:
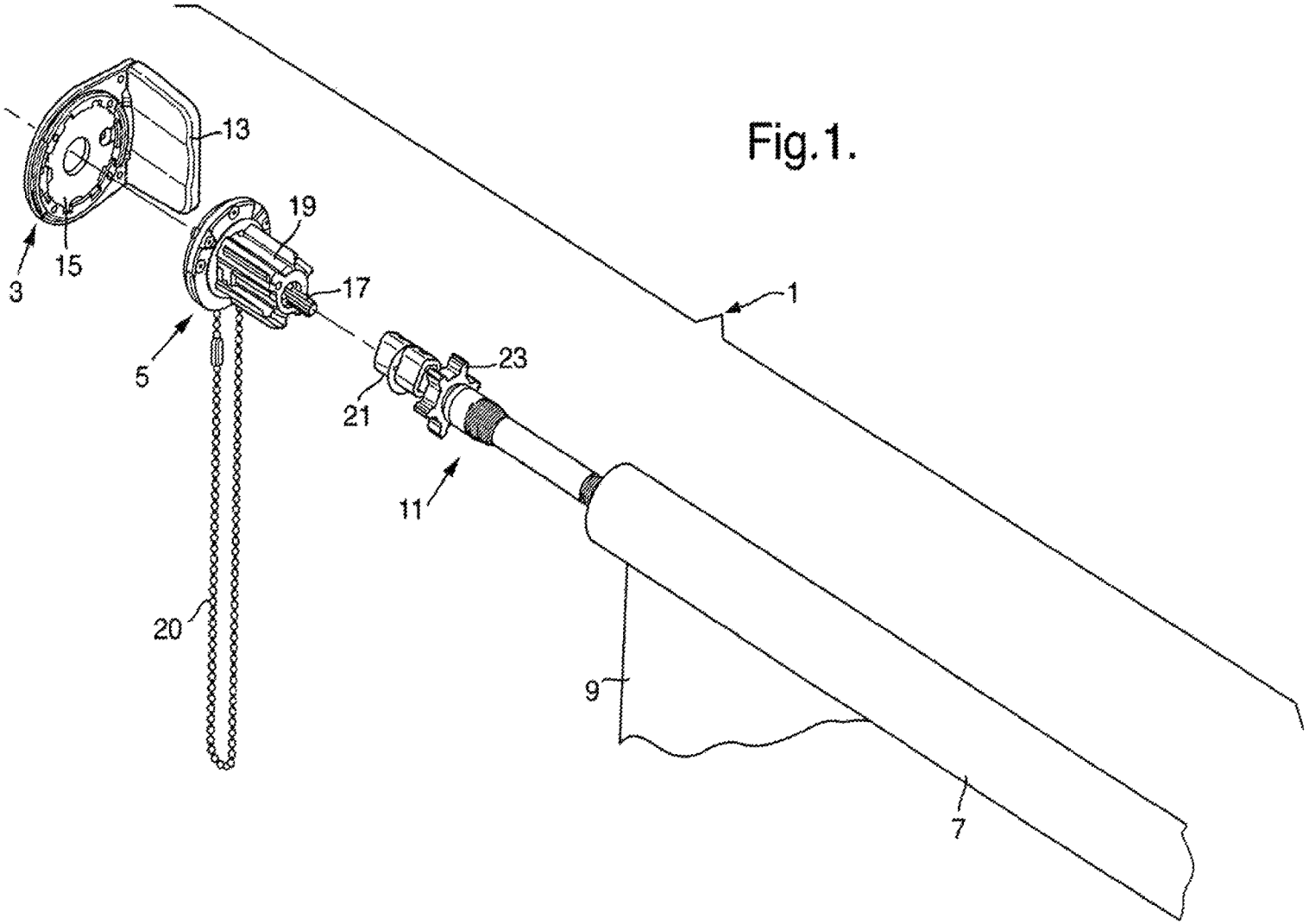
FIG. 1 is a perspective partial view, in explosion, of a driving end of a roller blind.

A roller blind 1, as partially shown in FIG. 1 in an exploded arrangement, includes a mounting bracket 3, a drive unit 5 and a blind roller 7. The blind roller 7 comprises a sheet 9 of flexible material, such as a fabric, that can be wrapped onto and unwrapped from, a tubular core (hidden from view by windings of the sheet material 9, but otherwise conventional). An unwrapped free end of the flexible sheet 9 can be provided with a bottom bar (not shown) for additional weight to keep the flexible sheet 9 taut, as is conventional.

The roller blind 1 of FIG. 1 is further provided with a first spring selected according to a Protocol that ensures that the blind will be operated with a constant operating force or torque.

A roller blind without a spring would operate in winding and unwinding the sheet 9 from roller 7 at a constant operating force. The torque needed depends on the parameters of the blind and would develop as a straight line with a constant angle of increase. This torque plot or torque curve is the basis for the Protocol to select a made to measure spring for the roller blind.

The result will be that the spring will fit exactly to the needs of the blind. For example in a roller blind of 3 meters width and 3 meters height and with a ball chain operator, the force needed to operate the blind will be 30 N for lifting the roller sheet 9 and winding it about the roller 7 and 2.7 N for lowering.

With a spring selected according to the Protocol this can be reduced e.g. to 8.7 N for lifting and 8.7 N for lowering, these values are chosen because when hand operated the user manipulating the blind experiences this amount of force as relatively light to handle. Of course other forces can be selected too. The Protocol includes at least the following three rules, i) the parameters of the blind, to which the spring is to be fitted, are determined, including the length and diameter of the roller, the size, thickness and weight of the sheet and the weight of the bottom bar, ii) from i), a torque curve is calculated for the blind, iii) from ii), the characteristics of a spring or a plurality of springs matching the blinds torque curve are calculated; preferably, the spring characteristics are calculated, using at least formula 1, above, especially both formulas 1 and 2, above; in doing so, the wire diameter and spring diameter of a pre-selected spring can be inserted in the formula(s) to calculate for that spring the exact length that will suit the roller blind and match it's torque curve.

The third rule of the Protocol also takes into account the maximum number of rotations of the pre-selected spring with respect to calculating its length, as well as a standard initial length.

Once the Protocol has been used for a specific blind and a first pre-selected spring of a certain diameter and with a certain wire diameter, the first three rules of the Protocol can be repeated by pre-selecting different spring types. In the market many, many springs are available of different characteristics and prices. Thus the repeated use of the Protocol allows to search and select technically and economically preferred springs and use such springs in the blind. As a result of repeatedly using the Protocol, multiple lengths of one or more spring types, rather than a single length of a single spring type, may be selected and the combination of the springs resulting in the desired torque curve for the blind that will ensure that the blind operates with the constant operating force.

A further rule of the Protocol may take into account the desired or used pre-tensioning of the spring or springs.

As shown in the roller blind of FIG. 1, the spring assist can be provided in the form of a spring assist module 11. The module will ensure that the operating drive unit 5 can be installed at will at the right or left end of the roller.

Bracket 3 has a flange 13 for mounting on a wall surface (not shown, but conventional). The mounting bracket 3 is further provided with a connector plate 15 for receiving and mounting the drive unit 5. The drive unit 5 has a stationary i.e. non-rotatable, central journal 17 and a rotatably driven end 19 for engagement with the blind roller 7. Manual drive force is provided by a ball chain loop 20. The drive unit 5 can be any conventional driving clutch mechanism as disclosed in U.S. Pat. No. 6,685,592 or U.S. Pat. No. 7,195,052 and thus does not form part of the present invention. Alternatively the drive unit 5 may also be replaced by a motorized operated drive unit, such as an electric motor drive unit of conventional design.

The spring assist module 11 has a first connector 21 for non-rotatably coupling to the stationary central journal 17 of the drive unit 5. Further the spring assist module 11 is provided with a flange portion of a rotatable member 23 having radially extending formations for engagement with complimentary formation on an inside of the blind roller 7 (not shown but conventional).

Figure 2A:
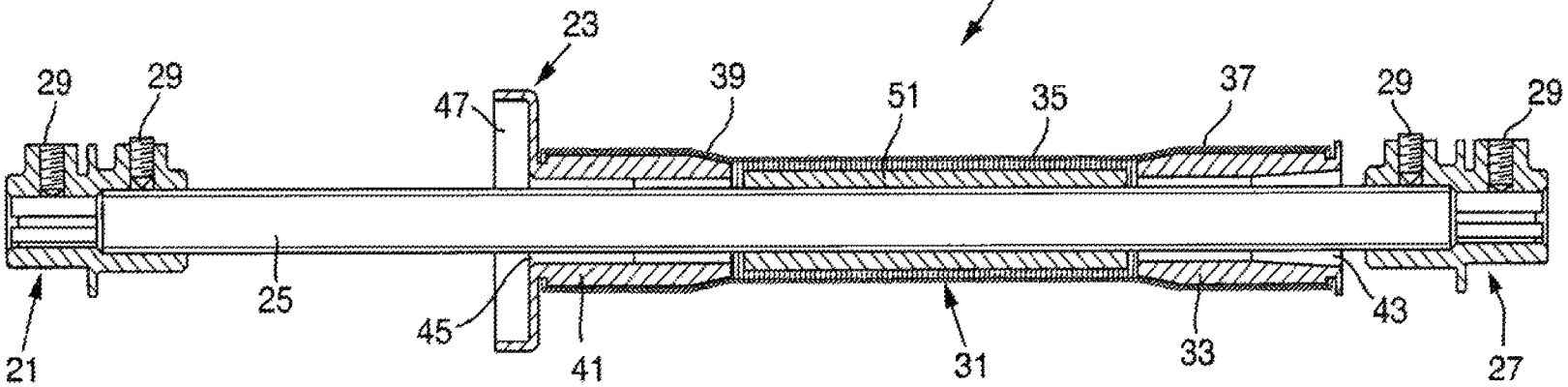
FIG. 2A is a longitudinal cross section of a spring assist module according to a first embodiment.
Figure 2B:
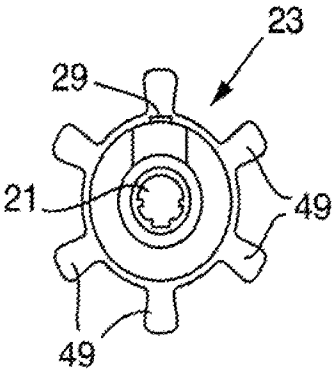
FIG. 2B is an end view of the spring assist module of FIG. 2A.

The first embodiment of spring assist module 11 will now be described in more detail, in reference to FIGS. 2A and 2B. A basis for the spring assist module 11 is formed by a stationary member or carrier in the form of a central shaft 25. The central shaft 25 is provided with an unround continuous profile, which can be square or splined to non-rotatably connect with other elements of the spring assist module. One such element is the first connector 21, defining a first axial end of the spring assist module 11. An opposite axial end is defined by a second connector 27. Each of the first and second connectors 21, 27 are non-rotatably secured to the central shaft 25 by means of a set screw 29. Accommodated between the first and second connectors 21, 27 is a spring assist member 31 that is composed of a first plug 33, non-rotatably, but preferably slidably coupled to the stationary central shaft 25, a helically wound torsion spring 35 and the rotatable member 23. The torsion spring 35 has a first axial end portion 37 clampingly engaged on an outer circumference of the first plug 33. A second axial end 39 of torsion spring 35 is clampingly engaged on a second plug 41 forming part of the rotatable member 23. The first plug 33 has a central bore 43 that is contoured to non-rotatably mate with the outer contour of the central shaft 25. The second plug 41 has a central bore 45 that is large enough to permit rotation about the outer contour of the central shaft 25.

The rotatable member 23 is further provided with a flange portion 47 that extends in an axial direction from an end of the second plug 41 beyond the torsion spring 35. As best seen in FIG. 2A this axially extending flange portion 47 is provided with a circumferentially shaped contour of radially extending projections 49 for engaging mating formations on a driven member, such as a blind roller, of an architectural covering. Blind roller tubes with such mating internal formations are well known in the art and a further description is therefore deemed unnecessary. To prevent the torsion spring 35 to sag and cause mechanical noises by touching the central stationary shaft 25, a dampening tube 51 is interposed between the spring 35 and shaft 25. The dampening tube 51 can be conveniently made from PVC or like plastics material.

Figure 3A:
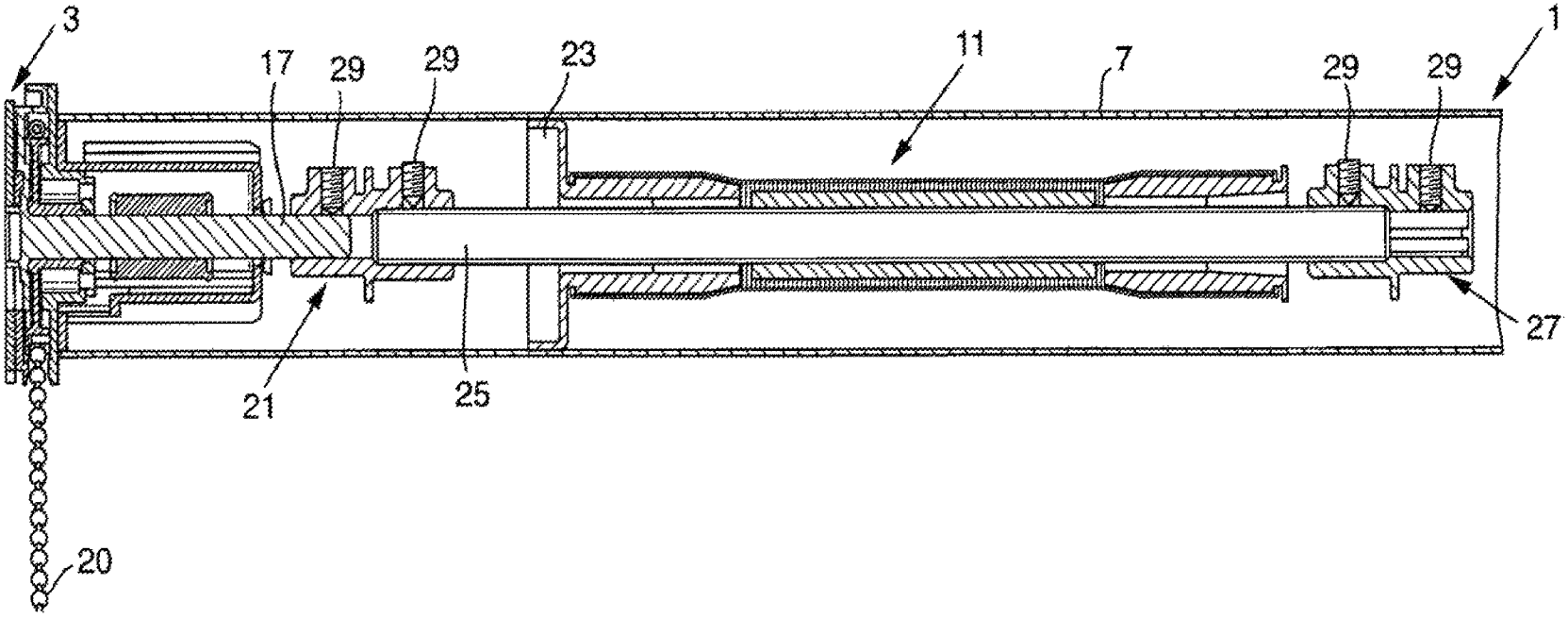
FIG. 3A is a partial front elevation, in cross section, of roller blind having a driving mechanism and the first embodiment of spring assist module at the left side of the roller blind.

In FIG. 3A the roller blind 1 of FIG. 1 is shown in an assembled state. In this cross sectional view it can be readily recognized that the first connector 21 of the spring assist module 11 is connected to the stationary central journal 17 of the drive unit 5. This connection can be fixed by another set screw 29.

Figure 3B:
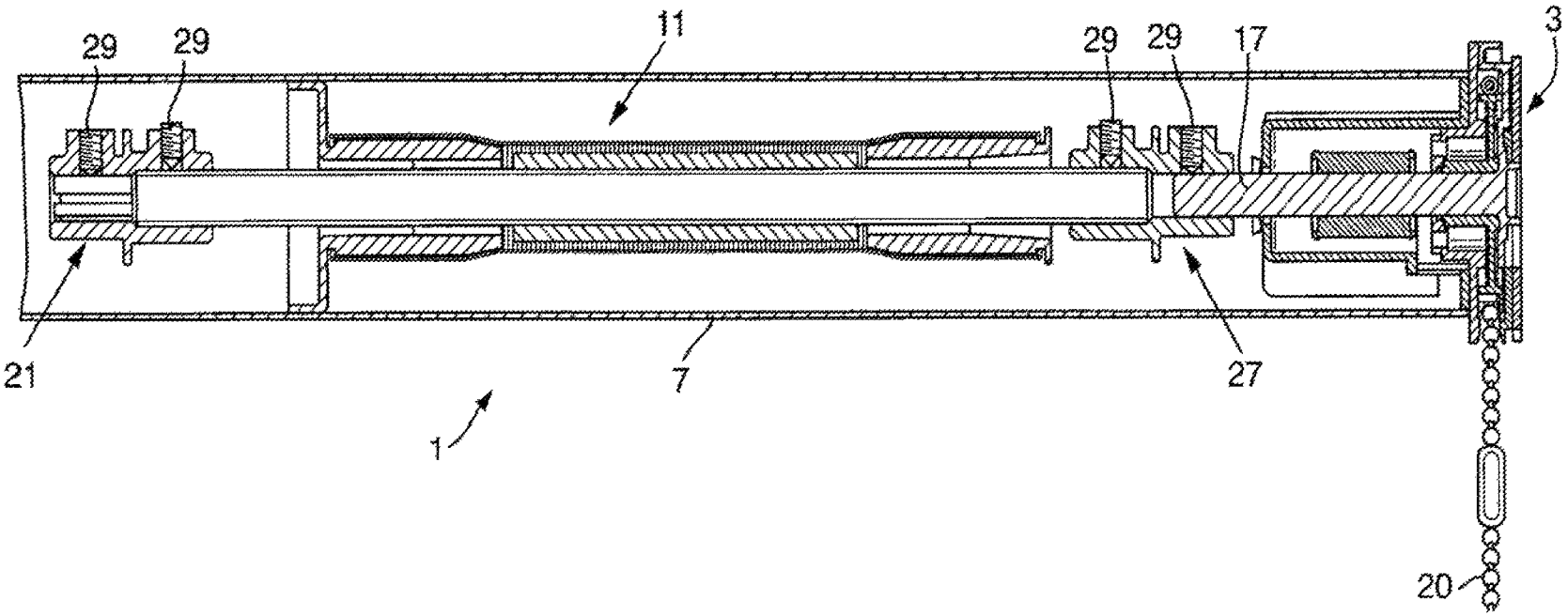
FIG. 3B is a partial front elevation, in cross section, of roller blind having a driving mechanism and the first embodiment of spring assist module at the right side of the roller blind.

FIG. 3B illustrates how the same spring assist module 11 may be positioned at the right hand end of a blind roller 7 and connected to the stationary journal 17 of a drive unit 5 by means of the second connector 27 and a corresponding set screw 29.

If so desired the roller blind with the drive unit 5 attached to the left side of the roller end as shown in FIG. 3A, can be easily converted into a roller blind with the drive unit 5 attached to the right side of the roller blind as shown in FIG. 3B using the same spring assist module 11. In order to do so the roller blind is disconnected from the bracket 3 and adaptor plate 15. The drive unit 5 is pulled out of roller 7 until first connector 21 is also outside of the roller. Set screw 29 closest to the drive unit 5 is loosened and drive unit 5 can be disengaged from the connector 21 and thus from the spring assist module 11. Using a long stick-like tool, the spring assist module can now be pushed through roller 7 to the other end of the roller until second connector 27 projects from that end. The drive unit can be attached to connector 27 its screw 29 fastened, and the end mounted to a bracket. Obviously a roller blind in order to be mounted will have a pair of brackets. These are not disclosed in the figures.

Figure 4:
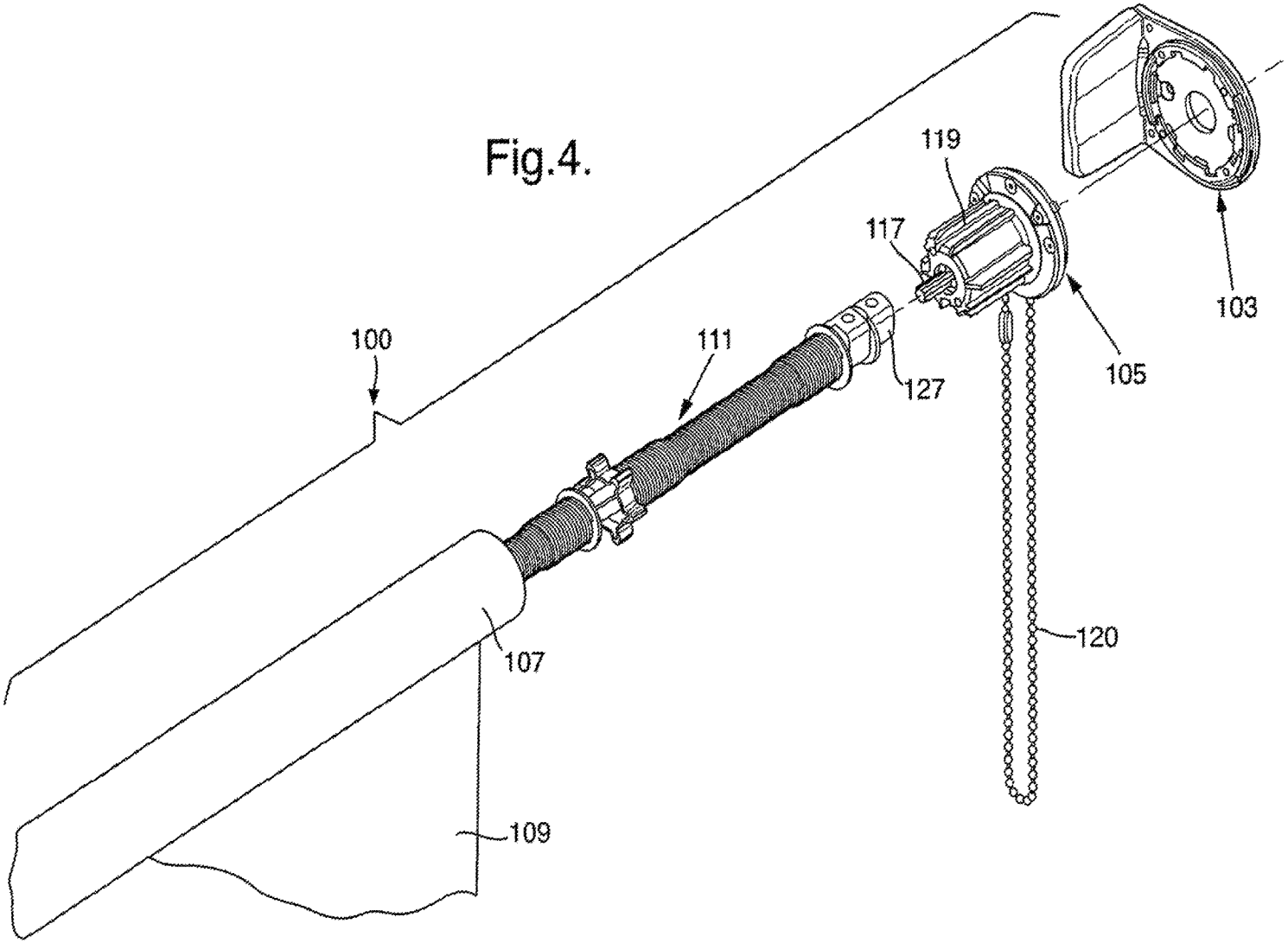
FIG. 4 is a perspective partial view, in explosion, of a driving end of a roller blind, somewhat similar to FIG. 1, but showing a drive to the right hand end and using a spring assist module according to a second embodiment.

FIG. 4 shows a second embodiment of roller blind 100 equipped with a spring assist module 111, in an arrangement similar to FIG. 1, but showing the drive unit 105 at the right end of the roller blind, rather than at the left end of the roller blind 100. The blind 100 of FIG. 4 further includes a mounting bracket 103, a drive unit 105 for driving a blind roller 107, so as to wind or unwind a blind fabric or sheeting 109. The second embodiment of spring assist module 111 also has a second coupling 127 for engagement with a non-rotatable central journal 117 of the drive unit 105. The drive unit 105 further has a rotatable drive end 119 that can be set into rotative motion by a ball chain loop 120.

Figure 5:
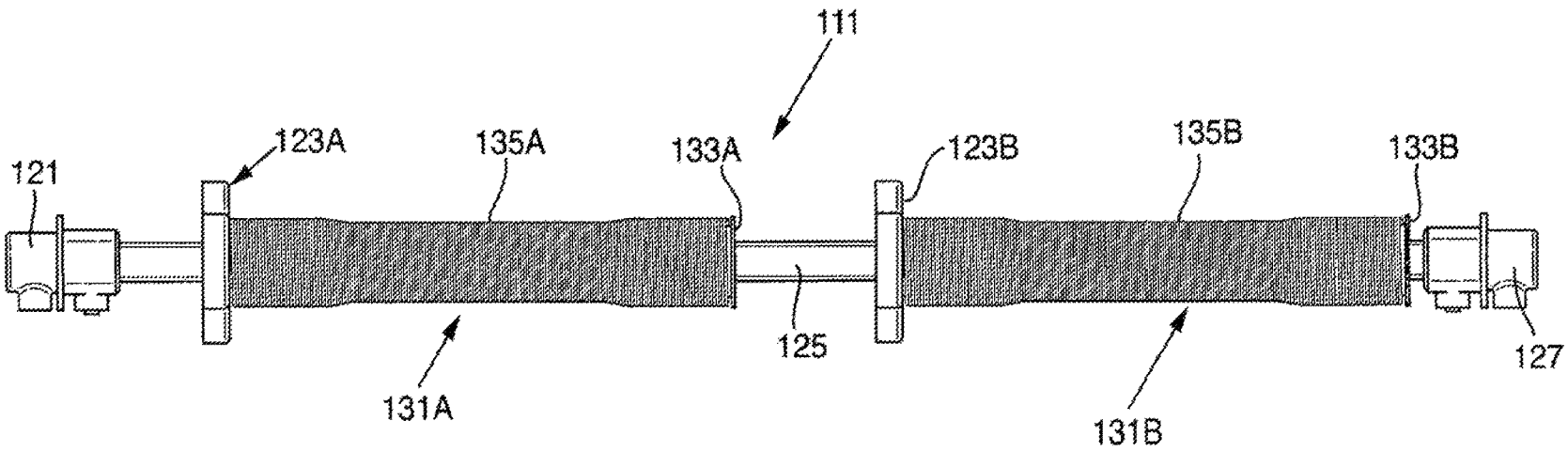
FIG. 5 is a longitudinal elevation of the second embodiment of spring assist module.

FIG. 5 shows the spring assist module 111 according to the second embodiment before it is being mounted in a roller blind or like coverings for architectural openings. As with the first embodiment shown in FIG. 2A, a stationary central shaft 125 forms a basis for the spring assist module 111. The central shaft 125 is substantially similar to that of the first embodiment, except that is may be of a longer length. Opposite axial ends are again defined by a first coupling connector 121 and a second coupling connector 127. Positioned about the central shaft 125, and between the first and second couplings 121, 127, are a first spring assist member 131A and a second spring assist member 131B. Each of the first and second spring assist members 131A, 131B includes a helically wound torsion spring 135A, 135B, respectively, the springs being selected by the Protocol, and as such can be identical units. The first and second spring assist members are adapted to operate in parallel between the stationary shaft 125 and a blind roller to increase or double the assist force in cases where such is required. The invention recognizes that with an increase in desired assisting torque, torsion spring 135A, 135B need to provide a higher torque. Since shorter springs of the same wire and spring parameters yield a higher torque it would be possible to use shorter springs. Shortening the spring length has its limits, a too short spring will not be able to make the required number of rotations because the tension in the spring wire will become too high. Thus when shorter springs are to be used, use of the Protocol to select the springs can lead to more and shorter springs of the same type, of shorter springs of different types of spring wire diameter and/or spring diameter and lengths.

The use of a pair of spring assist members 131A and 131B is shown FIG. 5 in the second embodiment of spring assist module 111. Each spring assist member 131A, 131B similar to the first embodiment has a first plug 133A, 133B and a rotatable member 123A, 123B. The helically wound first and second torsion springs 135A, 135B each uses the same size of spring wire and the same winding diameter to simplify stock keeping. The first and second springs 135A, 135B may each be confectioned to different lengths, subject to requirement. Likewise as described above springs used in the spring assist module can be of different types of springs w.r.t. the wire diameter and/or spring diameter and of different lengths.

It should be clear from the foregoing that the spring assist module according to the invention is not limited to a multiplicity of only two spring assist members, but that any multiplicity of three or more spring assist members in combined operation is possible. Also any number of second spring assist members with springs of the same type i.e. with same spring wire thickness and/or spring winding diameters, or with springs of different types having different spring wire thickness and/or spring winding diameters. The chosen springs can have equal lengths or different lengths. When e.g. a choice is made from three types of springs each with a different combination of spring wire diameter and spring diameter, by using the Protocol a combination of two or three of these springs can be selected in order to match the blinds torque curve and have the blind operate with a constant operating force.

In conclusion the drawings show a roller blind construction, with a driving clutch mechanism provided between the roller tube and the operator for transmitting rotation of the operator to the roller tube. A screen is attached to the roller tube, which may be wound and unwound from the roller tube upon operation of the cord operator.

The construction further includes a spring assist module that includes a shaft, a spring and two connector adapters. The shaft is coaxially installed in the interior space of the roller tube. The spring is sleeved on the shaft, and has its first end coupled to the shaft and its second end coupled to the roller tube. The connector adapters each are connectable by e.g. two set screws, one to fix to the stationary shaft and the other one to fix to a stationary shaft of the cord operated drive unit.

The spring used in the assist module will assist reducing the force necessary to lift the blind by the drive unit. The operation of the module is as follows. The module is mounted in the roller blind such that when the operator is rotated, one end of the spring will rotate with the roller tube, while the opposite end will be held against rotation. When the blind is lowered, the spring will thereby be tightened. When the blind is lifted, the spring will unwind producing a rotational force on the roller tube and thereby assist lifting the blind.

The drive unit (including manually operated and power operated units) can be selectively engaged with either one of the two opposite roller blind tube ends. In order to do so the drive unit can be disengaged from the connector adaptor to which it was connected. The spring assist module can now be pushed through the roller tube to the other end. The drive unit can be attached to the opposite connector adaptor now closest to the tube end. In this way a roller blind with e.g. back drop can be operated from either side, using only the same spring in the assist module.

The springs of the module are preferably selected according to the Protocol to take into account the parameters and torque curve of the blind to be operated.

Figure 6:
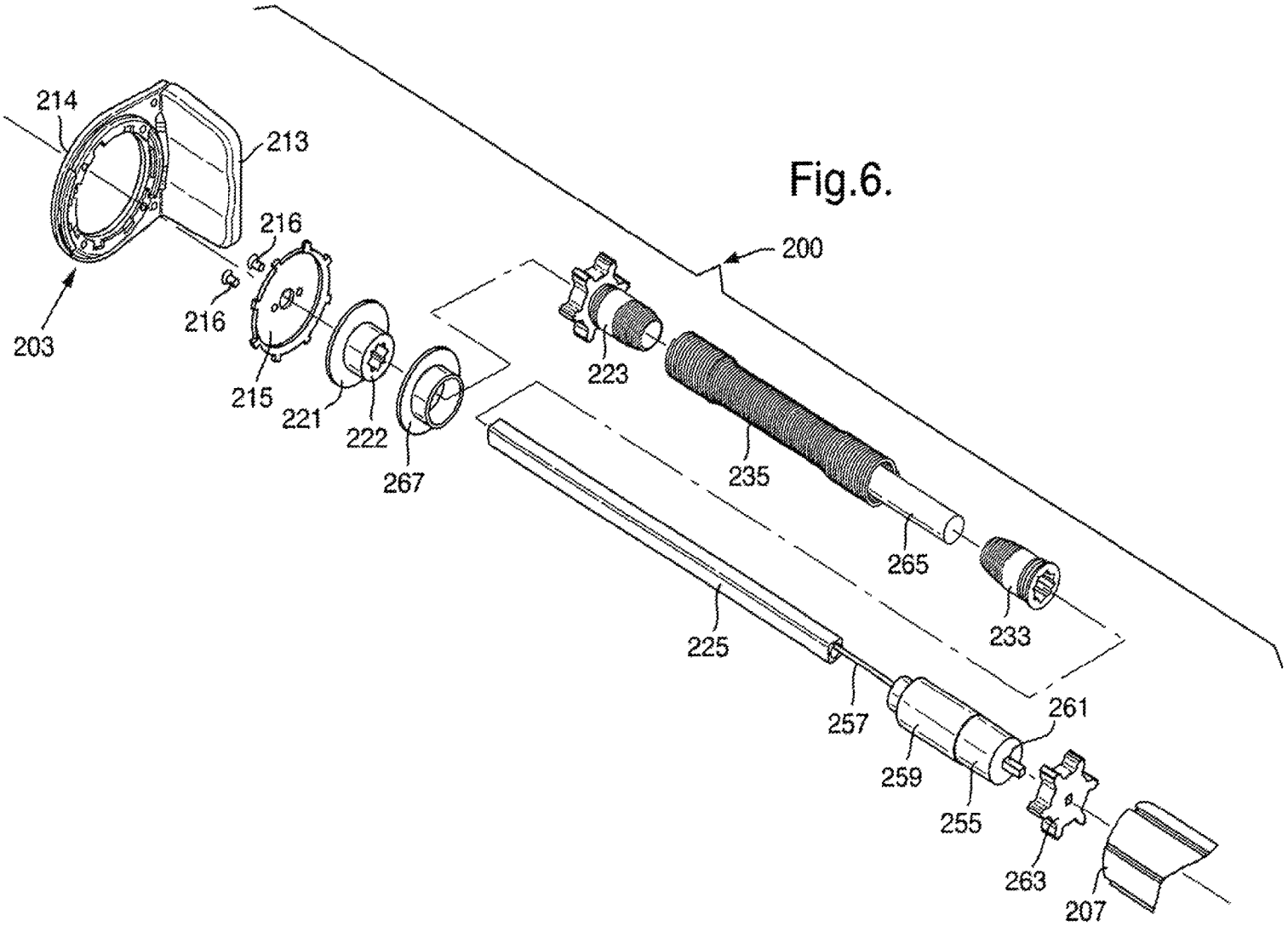
FIG. 6 is a perspective exploded view of a third embodiment using automatic power drive means.
Figure 7:
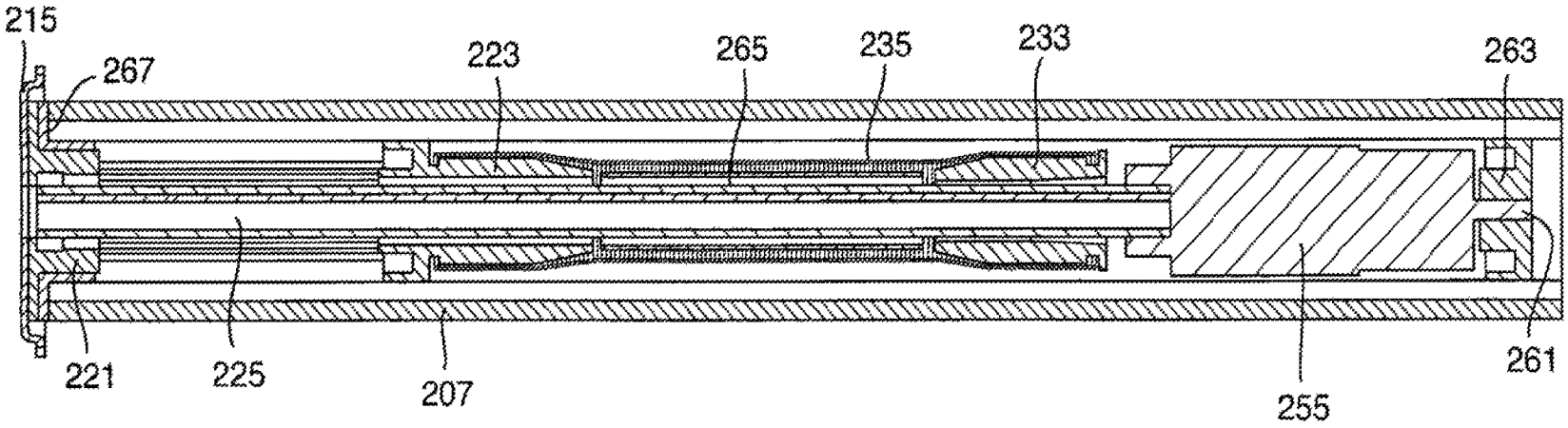
FIG. 7 is a longitudinal cross section of the third embodiment in an assembled arrangement.

A third roller blind embodiment 200 is partially shown in FIG. 6 as a perspective exploded view. Reference numerals used in describing this embodiment are generally a full "100" or "200" different from those used in describing the previous embodiments, when referring to functionally similar elements. A longitudinal cross section of the third embodiment in an assembled arrangement is shown in FIG. 7. This fourth embodiment 200 uses an automatic power drive means, in the form of an electric motor 255. The roller blind has a mounting bracket 203 with a mounting flange 213 for mounting to a wall surface or the like (not shown, but conventional). The mounting bracket 203 has a receiving mount 214 for a connector plate 215. The connector plate 215 is to be non-rotatably received by the receiving mount 214 of the bracket 203. Also non-rotatably connected to the connector plate 215, by means of screws 216, is stationary connector 221. The stationary connector 221 has a central cavity 222 for non-rotatably receiving a square shaft 225. The square shaft 225 has a hollow interior for accommodating an electrical lead wire 257 for powering the electric motor 255. The electric motor 255 has a motor adapter 259, facing the square shaft 225 for non-rotatably coupling the motor 255 to the square shaft 225. The electric motor 255 has an output shaft 261 on its end remote from the square shaft 225. The output shaft 261 is adapted to be rotated when the electric motor 255 is energized by the electrical wire 257, which for this purpose extends outwardly from bracket 203 (at the left hand end of the cross section shown in FIG. 7). The motor output shaft 261 is non-rotatably connected to a rotatable roller engaging member 263, keyed to the blind roller tube 207 for rotating it. Concentrically about the stationary square shaft 225 is arranged a helically wound torsion spring 235, which can be provided with an inner spring sleeve 265 to reduce contact noise between the torsion spring 235 and the centrally positioned stationary shaft 225. The helically wound torsion spring 235 on one of its longitudinal ends engages a stationary plug member 233. The stationary plug member 233 is stationary coupled to the square shaft 225. At an opposite one of its longitudinal ends, the helically wound torsion spring 235 is coupled to a rotatable plug member 223. The rotatable plug member 223 is rotatably supported about the central stationary square shaft 225, as further shown in FIG. 7. The rotatable plug member 223 includes a radially extending contoured flange 247 for engaging a mating formation on an inside of the driven blind roller tube 207. Accordingly a stationary carrier for the spring assist module is here provided by components including the central square shaft 225, the stationary connector 221 and the stationary plug member 233. When assembled the blind roller tube 207 is rotatably supported on a collar 267 bearing on the stationary connector 221, as further shown in FIG. 7. The roller blind, as is conventional, may further have a covering member such as a sheet of flexible material to be at least partially wrapped about the blind roller tube 207 and a bottom weight bar along a lower horizontal edge of the sheet. The blind fabric and bottom bar are deleted from FIGS. 6 and 7. As the skilled person will readily perceive the relative positions of the rotatable and stationary plug members 223, 233 of the spring assist module can alternatively be inversed, in that the rotatable plug member 223 is positioned closest to the motor 255, rather than the stationary plug member 233.

A fourth embodiment with automatic power drive is partially illustrated in FIG. 8 in again a perspective exploded view. This fourth embodiment in its assembled condition is visible in FIG. 9 as a longitudinal cross section thereof. The fourth embodiment of a spring assist module is embodied by roller blind 300. This roller blind 300 includes a mounting bracket 303 and a blind roller tube 307. The mounting bracket 303 has a usual mounting flange 313 and a receiving mount 214 for a connector plate 315. This arrangement is similar to that of the third embodiment and the connector plate 315 will be stationary held in the receiving mount 214. Fixed to the connector plate 315 is a stationary plug member 333, which is non-rotatably mounted to the connector plate 315 by screws 316. The stationary plug member 333 has a shaped internal cavity 334 for non-rotatably receiving the square centre shaft 325. Bearing on the stationary plug member 333 is a collar 367 for rotatably supporting the blind roller tube 307. A helically wound torsion spring 335 has one of its longitudinal ends engaging the stationary plug member 333. Fitted to an end of the stationary square shaft 325, opposite of the stationary plug member 333, is a motor adapter 359, which non-rotatably supports electric motor 355. The electric motor 355 can be energized in each of its opposite directions of rotation by an electrical wire 357 extending through a hollow centre of the square shaft 325. The electric motor 355 is further provided with a rotatable output drive shaft 361. The output drive shaft 361 drivingly engages a rotatable engagement member 369. The rotatable engagement member has a radially extending contoured flange for engaging mating contours on an inside of the blind roller tube 307. As best seen in FIG. 9, the entire spring 335 extends axially over the electric motor 355 and engages a perimeter surface of the rotatable engagement member 369. In this way both the helically wound spring 335 and the electric motor 355 can be effective in driving the rotatable engagement member 369.

Figure 8:
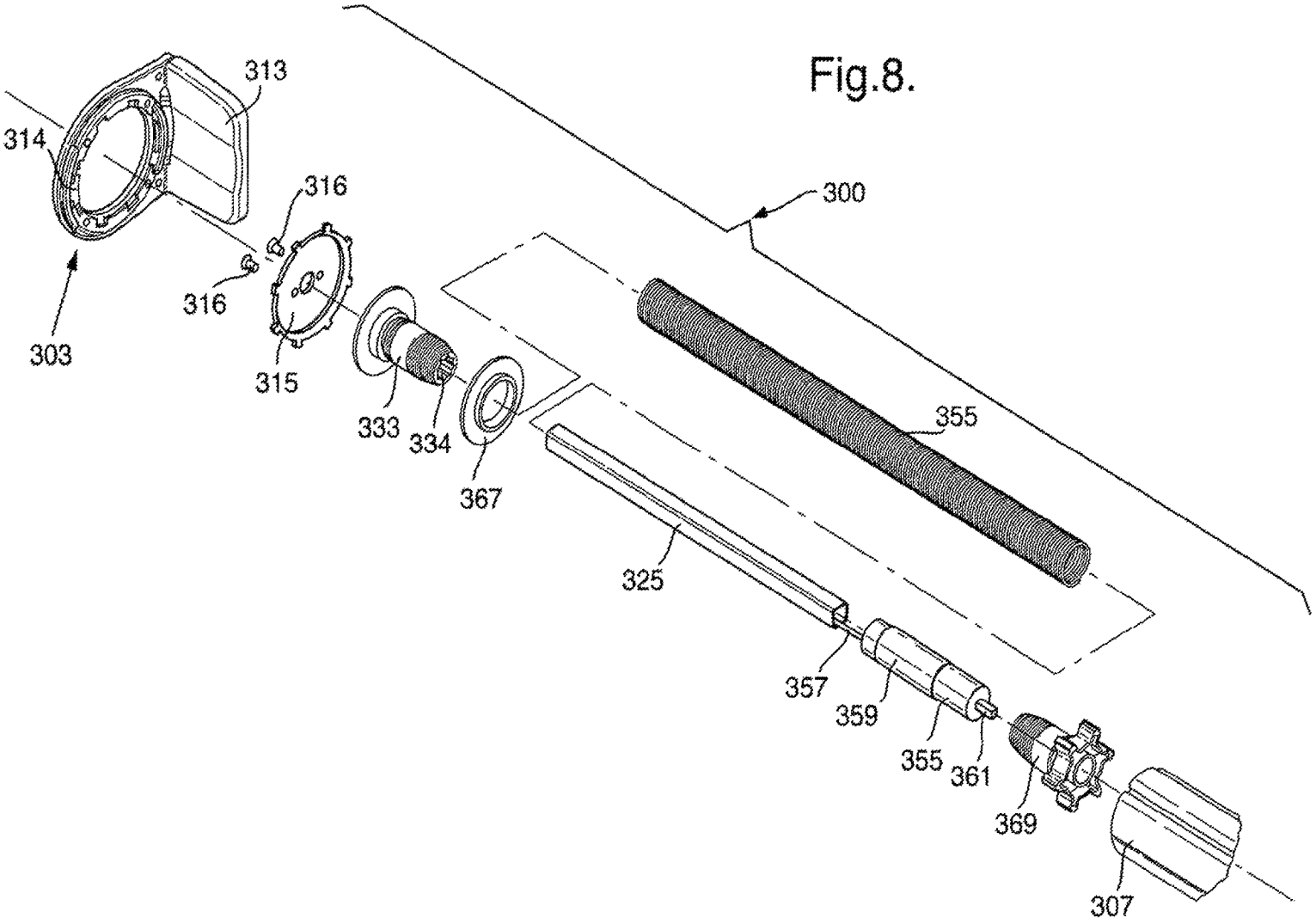
FIG. 8 is a perspective exploded view of a fourth embodiment with automatic power drive.
Figure 9:
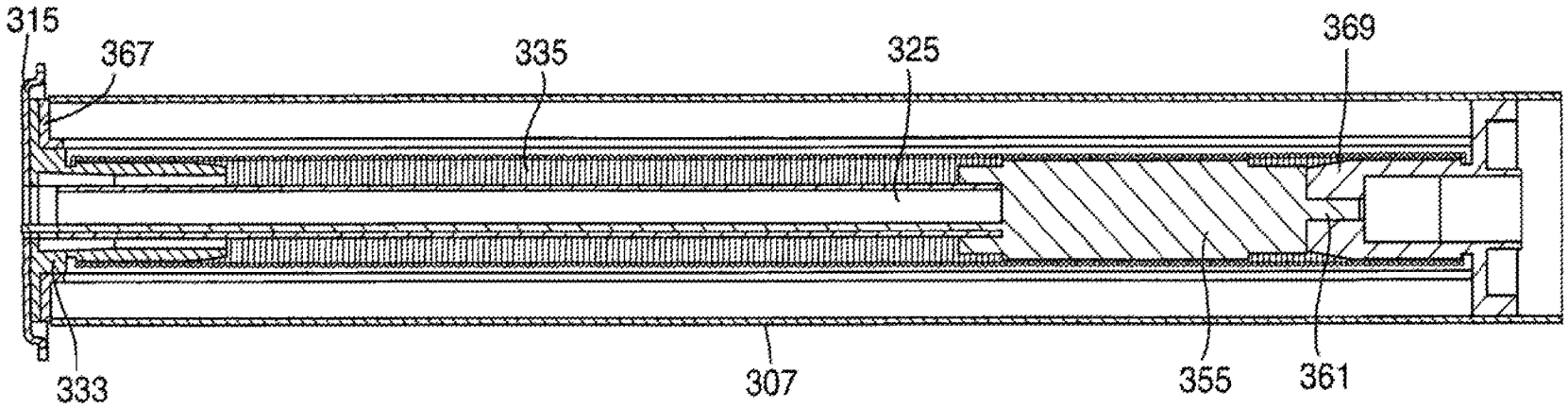
FIG. 9 is a longitudinal cross section of the fourth embodiment in its assembled condition.

Based on the above explanation, it is clear that the fourth embodiment of FIGS. 8 and 9 results in a much more compact arrangement than the third embodiment of FIGS. 6 and 7. As regards the size of roller blinds, the length of a blind roller tube is depending on the width of the blind. In situations where only limited length is available to accommodate the spring assist mechanism and the drive motor, the arrangement of the fourth embodiment may be at an advantage, because it has the motor housed within the spring assist module. Also the fourth embodiment requires a reduced number of individual components, which could be advantageous from an economic point of view.

Thus a covering for an architectural opening, such as a roller blind, may have one of the spring assist modules described hereinabove. Such a spring assist module for use with an architectural covering or roller blind includes a stationary carrier, a rotatable member adapted to be keyed to a driven part of the architectural covering, such as a blind roller tube and a torsion spring. The torsion spring has a first end operatively coupled to the stationary carrier and a second end operatively coupled to the rotatable member. In use, upon rotation of the rotatable member in one direction of rotation, kinetic energy will be stored by the torsion spring from the rotatable member. Upon subsequent rotation of the rotatable member in an opposite direction of rotation, any kinetic energy stored by the torsion spring will then be released to the rotatable member. The spring assist module, being pre-assembled as a self-contained unit, can as demonstrated above also optionally cooperate with an automatically operated powered driving means, such as an electric motor. Such an electric motor, being assisted by the spring assist module, can be less powerful than without the use of a spring assist module. This will result in both a reduction of size and cost.

It is thus believed that the operation and construction of the present invention will be apparent from the foregoing description. To the skilled person in this field of the art it will be clear that the invention is not limited to the embodiment represented and described here, but that within the framework of the appended claims a large number of variants are possible. To this aspect it will be clear that the Protocol can be used for a number of roller blinds that are coupled together in length. In such a roller blind assembly the torque curve or torque plot of the combined roller blinds can be calculated and a combination of a plurality of springs and/or spring assist modules to match the torque curve of the blind can be calculated and selected by using the Protocol. Although the drawings of the application only show spring assisted roller blinds with spring assist modules, the Protocol can also be used to calculate and select drive springs for spring driven roller blinds. Of course the Protocol can also be used to calculate and select the springs for a spring assisted roller blind not using the spring assist module.

Also kinematic inversions are considered inherently disclosed and to be within the scope of the present invention. The terms comprising and including when used in this description or the appended claims should not be construed in an exclusive or exhaustive sense but rather in an inclusive sense.

This invention is, of course, not limited to the exact details of the above-described embodiments which may be modified without departing from the scope of the claims or sacrificing all of its advantages. In this regard, the terms in the foregoing description and the following claims, such as "right", "left", "front", "rear", "above", "beneath", "vertically", "horizontally", "longitudinally", "upper", "lower", "top" and "bottom", have been used only as relative terms to describe the relationships of the various elements of the roller blinds with or without the spring assist module as described and shown in the figures.

What is claimed is:

1. A method of selecting one or more springs for a roller blind, comprising:

providing a roller blind including a roller, a sheet attached to said roller for winding and unwinding from said roller, and a bottom rail;

determining one or more parameters of the blind, including a roller length, a roller outer diameter, a sheet length, a sheet weight, a sheet height, a sheet thickness, and a bottom rail weight;

determining a torque curve of the blind based on the one or more parameters of the blind;

selecting a first spring having a wire diameter and a spring diameter, said first spring being operatively connected to the roller to drivingly rotate the roller in at least one direction of rotation; and based on the torque curve, the wire diameter of the first spring, and the spring diameter of the first spring, determining a length of the first spring; wherein the wire diameter, the spring diameter, and the length of the first spring are selected to match the torque curve.

2. The method of claim 1, further comprising:

determining a revised torque curve of the blind based on the one or more parameters of the blind and on an operating torque of the first spring;

selecting a second spring having a wire diameter and a spring diameter, said second spring being operatively connected to the roller to drivingly rotate the roller in at least one direction of rotation; and based on the revised torque curve, the wire diameter of the second spring, and the spring diameter of the second spring, determining a length of the second spring such that the combination of the first spring and the second spring ensures the blind operates with a constant operating force.

3. The method of claim 2, wherein the first spring and the second spring have identical lengths.

4. The method of claim 2, wherein the first spring and the second spring have different lengths.

5. The method of claim 2, wherein the first spring and the second spring have identical wire diameters.

6. The method of claim 2, wherein the first spring and the second spring have identical spring diameters.

7. The method of claim 2, wherein the first spring and the second spring have identical wire diameters and spring diameters.

8. The method of claim 2, wherein the first spring and the second spring have different wire diameters, spring diameters, or both.

9. The method of claim 1, wherein determining the one or more parameters comprises:

determining an outer diameter of a roller;

determining a height, a width, a thickness, and a weight of a sheet attached to the roller; and determining a weight of a bottom rail attached to the sheet.

10. The method of claim 1, wherein the length of the first spring ensures the blind operates with a constant operating force.

11. The method of claim 1, further comprising:

operatively coupling a first end of the first spring to a central shaft to limit rotational movement of the first end of the first spring relative to the central shaft;

operatively coupling the second end of the first spring to a rotatable member; and wherein in use upon rotation of the rotatable member in one direction kinetic energy is stored by the first spring and upon rotation of the rotatable member in an opposite direction kinetic energy stored by the spring may be released to the rotatable member.

12. The method of claim 11, further comprising:

providing a connector on each end of the central shaft, each of the connectors operable to interchangeably connect either end of the first spring to the roller blind.

13. A method of assembling a roller blind, comprising:

attaching a first end portion of the first spring of claim 1 to a stationary member; and attaching a second end portion of the first spring of claim 1 to a rotatable member keyed to a roller such that rotation of the roller rotates the rotatable member, wherein kinetic energy is stored by the first spring from the rotatable member upon rotation of the rotatable member in one direction of rotation, and the kinetic energy stored by the first spring is released to the rotatable member upon rotation of the rotatable member in an opposite direction of rotation.

14. The method of claim 13, further comprising arranging the first spring, the stationary member, and the rotatable member around a stationary shaft.

15. A method of selecting one or more springs for a roller blind, comprising:

providing a roller blind including a roller, a sheet attached to said roller for winding and unwinding from said roller, and a bottom rail;

determining an outer diameter of the roller;

determining a height, a width, a thickness, and a weight of the fabric sheet attached to the roller;

determining a weight of the bottom rail attached to the fabric sheet;

determining a number of springs in the roller blind; and determining a length of each of the number of springs, the combined length of the number of springs configured to provide the roller blind with a constant operating force in lifting and lowering the sheet.

16. The method of claim 15, wherein the length of one or more of the number of springs is determined using the following formula:

$$LK1_{Fe} = \frac{LK0_{Fe} \times Md0_{Fe} \times M \times \left(\sqrt{\frac{4 \times h_{st} \times t_{st}}{\pi} + d_{we}^2} - d_{we}\right)}{\left[\begin{array}{c} d_{we} \times b_{st} \times (G_{ul} + h_{st} \times G_{st}) - \\ \sqrt{\frac{4 \times h_{st} \times t_{st}}{\pi} + d_{we}^2} \times b_{st} \times G_{ul} \end{array}\right] \times t_{st}}$$

in which:

$LK1_{Fe}$=calculated spring length adapted to the roller blind;

$LK0_{Fe}$=assumed spring length with respect to $Md0_{Fe}$;

$Md0_{Fe}$=assumed torque increase of the spring with respect to its length ($LK0_{Fe}$);

M=number of springs in the roller blind;

$d_{we}$=outer diameter of the roller;

$h_{st}$=height of the fabric sheet;

$b_{st}$=width of the fabric sheet;

$t_{st}$=thickness of the fabric sheet;

$G_{st}$=weight of the fabric sheet; and $G_{ul}$=weight of the bottom rail.

17. The method of claim 15, wherein the number of springs is determined using the following formula:

$$M = \left[\frac{\left[\left(\frac{\frac{\sqrt{\frac{4\times h_{st}\times t_{st}}{\pi}+d_{we}^2}-d_{we}}{2\times t_{st}}+\sqrt{\frac{4\times h_{st}\times t_{st}}{\pi}+d_{we}^2}\times b_{st}\times G_{ul}\times\left(\sqrt{\frac{4\times h_{st}\times t_{st}}{\pi}+d_{we}^2}-d_{we}\right)}{\left[d_{we}\times b_{st}\times(G_{ul}+h_{st}\times G_{st})-\sqrt{\frac{4\times h_{st}\times t_{st}}{\pi}+d_{we}^2}\times b_{st}\times G_{ul}\right]\times 2\times t_{st}}\right)\times\left(\frac{\left[d_{we}\times b_{st}\times(G_{ul}+h_{st}\times G_{st})-\sqrt{\frac{4\times h_{st}\times t_{st}}{\pi}+d_{we}^2}\times b_{st}\times G_{ul}\right]\times t_{st}}{\left(\sqrt{\frac{4\times h_{st}\times t_{st}}{\pi}+d_{we}^2}-d_{we}\right)}\right)\right]}{Md0_{Fe}\times n0_{Fe}}\right]$$

in which:

M=number of springs in the roller blind;

$d_{we}$=outer diameter of a roller;

$h_{st}$=height of a fabric sheet attached to the roller;

$b_{st}$=width of the fabric sheet;

$t_{st}$=thickness of the fabric sheet;

$G_{st}$=weight of the fabric sheet;

$G_{ul}$=weight of a bottom rail attached to the fabric sheet;

$Md0_{Fe}$=assumed torque increase of the spring with respect to its length ($LK0_{Fe}$); and $n0_{Fe}$=maximum number of rotations for $LK0_{Fe}$.

18. The method of claim 15, further comprising:

operatively coupling a first end of the first spring to a central shaft to limit rotational movement of the first end of the first spring relative to the central shaft;

operatively coupling the second end of the first spring to a rotatable member; and wherein in use upon rotation of the rotatable member in one direction kinetic energy is stored by the first spring and upon rotation of the rotatable member in an opposite direction kinetic energy stored by the spring may be released to the rotatable member.

19. The method of claim 18, further comprising:

providing a connector on each end of the central shaft, each of the connectors operable to interchangeably connect either end of the first spring to the roller blind.

* * * * *